US011090663B2

(12) United States Patent
Su

(10) Patent No.: US 11,090,663 B2
(45) Date of Patent: Aug. 17, 2021

(54) HEAD OF BLOW GUN THAT BLOWS A LARGE AMOUNT OF AIR

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 308 days.

(21) Appl. No.: 16/009,309

(22) Filed: Jun. 15, 2018

(65) Prior Publication Data

US 2019/0054478 A1 Feb. 21, 2019

(30) Foreign Application Priority Data

Aug. 18, 2017 (TW) ..... 106128109
Oct. 17, 2017 (TW) ..... 106135544

(51) Int. Cl.
*B05B 1/00* (2006.01)
*B05B 1/04* (2006.01)

(52) U.S. Cl.
CPC ..... *B05B 1/005* (2013.01); *B05B 1/044* (2013.01)

(58) Field of Classification Search
CPC ..... B05B 1/005; B05B 1/044; B05B 7/0087; A45D 20/12; A45D 20/122; F23D 14/50; F23D 14/52
USPC ..... 239/601
See application file for complete search history.

(56) References Cited

U.S. PATENT DOCUMENTS 2,029,337 A * 2/1936 Parker ..... B05B 7/0075 239/417.3
4,569,482 A * 2/1986 Hiruma ..... B08B 3/028 239/296
6,328,226 B1 * 12/2001 Goenka ..... B05B 7/0075 239/290
10,161,629 B2 12/2018 Yang
10,194,728 B2 2/2019 Stephens et al.
2008/0257986 A1 * 10/2008 Mau ..... B05B 1/3026 239/394
2008/0290193 A1 * 11/2008 Hursen ..... B05B 1/3006 239/455

(Continued)

FOREIGN PATENT DOCUMENTS

CN 202162177 U 3/2012
CN 102728490 A 10/2012
CN 103521378 A 1/2014

(Continued)

*Primary Examiner* — Tuongminh N Pham
(74) *Attorney, Agent, or Firm* — Alan D. Kamrath; Karin L. Williams; Mayer & Williams PC

(57) ABSTRACT

A head of a blow gun includes an inlet and an outlet openings formed by a main channel. The main channel defines a first section with a first open end adjacent to the inlet opening and a second open end and a second section with a first open end adjacent to the second open end of the first section and a second open end adjacent to the outlet opening. The second section has a cross section including two opposite short sides and two opposite long sides. The outlet opening is delimited by the short sides and long sides and has a long width between the short sides and a short width between the long sides respectively. At least one side channel has a first open end allowing the outside air to flow therein and a second open end fluidly connected to the second section.

13 Claims, 11 Drawing Sheets

(56) References Cited

U.S. PATENT DOCUMENTS

2012/0318891 A1* 12/2012 Chou ..... B05B 7/0087
239/291

FOREIGN PATENT DOCUMENTS

| | | | |
|---|---|---|---|
| CN | 203789380 | U | 8/2014 |
| CN | 104815773 | A | 8/2015 |
| TW | 551170 | U | 9/2003 |

* cited by examiner

HEAD OF BLOW GUN THAT BLOWS A LARGE AMOUNT OF AIR

BACKGROUND OF THE INVENTION

1. Field of the Invention

The present invention relates to a head of a blow gun and, particularly, to a head for a blow gun that blows a large amount of air.

2. Description of the Related Art

Refer to FIGS. 10 and 11, a conventional blow gun 90 includes a head 91 that can be disconnected from the blow gun 90. The head 91 has an interior defining a channel 92 and the channel 92 has an inlet end in which high pressurized air from the blow gun 90 flow in and an outlet end through which the high pressurized air flow out of the head 91. Furthermore, the head 91 includes openings 93 communicated with the channel 92 and when the high pressurized air flows out of the head 91 outside air can be drawn into the channel 92 through the openings 93. However, the outside air will deviate the flowing direction of the high pressurized air and causes turbulence in the high pressurized air. Consequently, the flow rate of the high pressurized air is decreased.

The present invention is, therefore, intended to obviate or at least alleviate the problems encountered in the prior art.

SUMMARY OF THE INVENTION

A head of a blow gun includes an inlet opening and an outlet opening formed by a main channel. The main channel extends from the inlet opening to the outlet opening. The main channel defines a first section with a first open end fluidly connected with and adjacent to the inlet opening and a second open end and extends along a longitudinal axis of the main channel. The main channel defines a second section with a first open end fluidly connected with and in proximity to the second open end of the first section and a second open end fluidly connected with and adjacent to the outlet opening and extends along a longitudinal axis of the main channel. The second section is of a cross section including two opposite short sides and two opposite long sides. The cross section of the second section varies along the longitudinal axis. The outlet opening is delimited by the short sides and the long sides and has a long width between the two short sides and a short width between the two long sides respectively. The long width is at least greater than two times of the short width. The minimum and maximum cross sections are perpendicular to the axis. At least one side channel is located on a side of the main channel and configured to allow outside air to flow into the second section. The at least one side channel has a first open end allowing the outside air to flow therein and a second open end fluidly connected to the second section.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
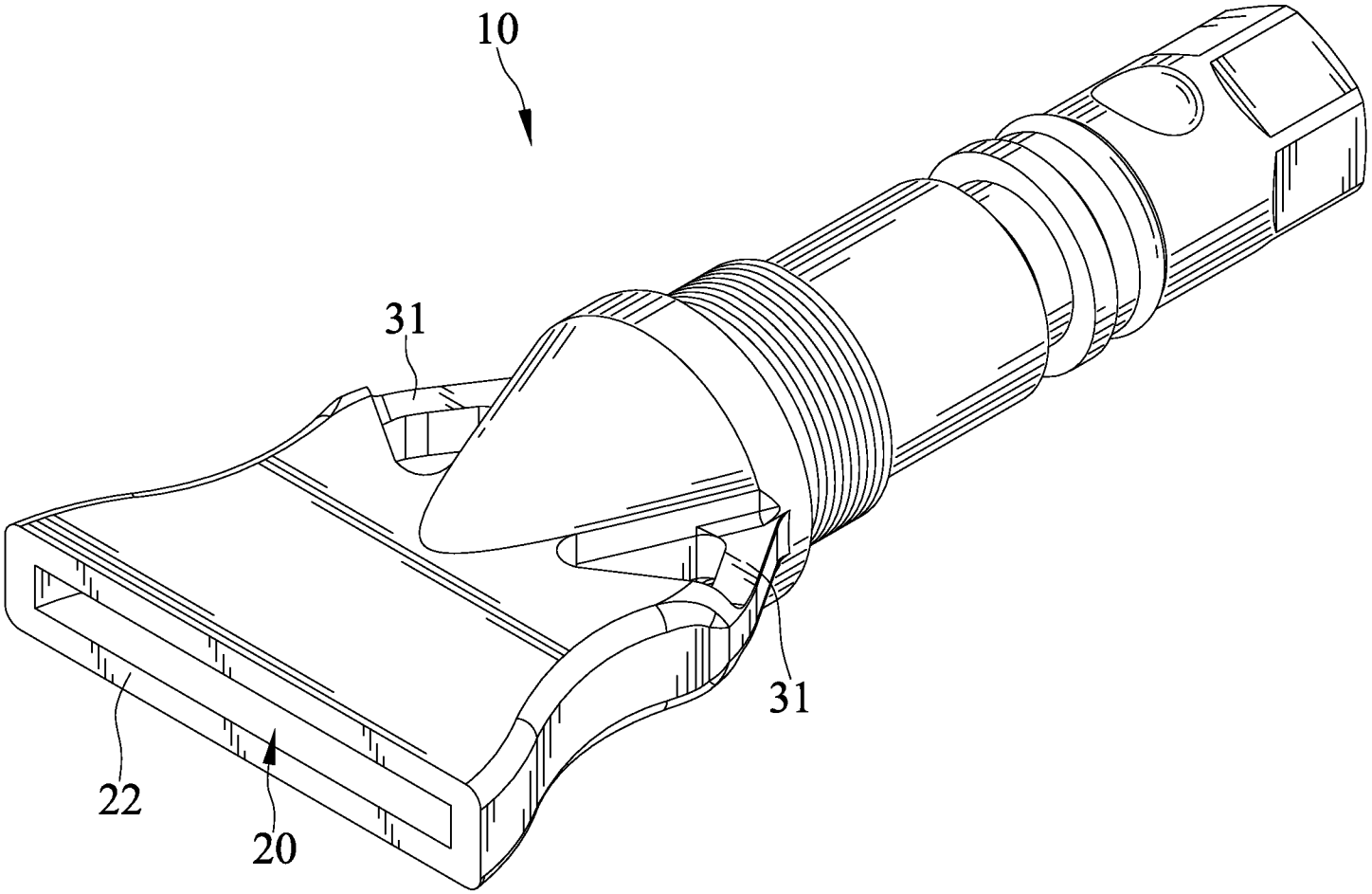
FIG. 1 is a perspective view of a head of a blow gun in accordance with a first embodiment of the present invention.
Figure 2:
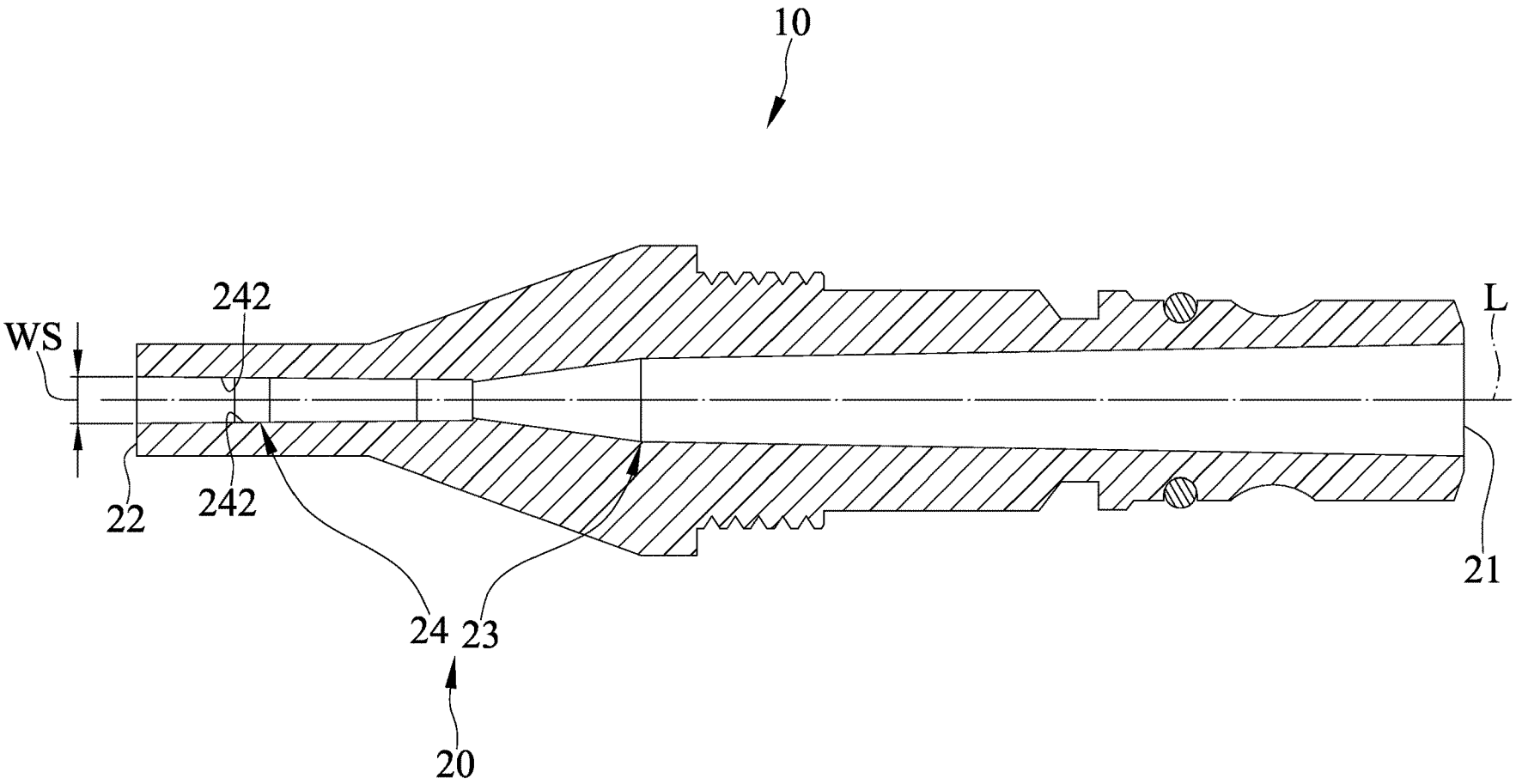
FIG. 2 is a cross-sectional view of the head of FIG. 1.
Figure 3:
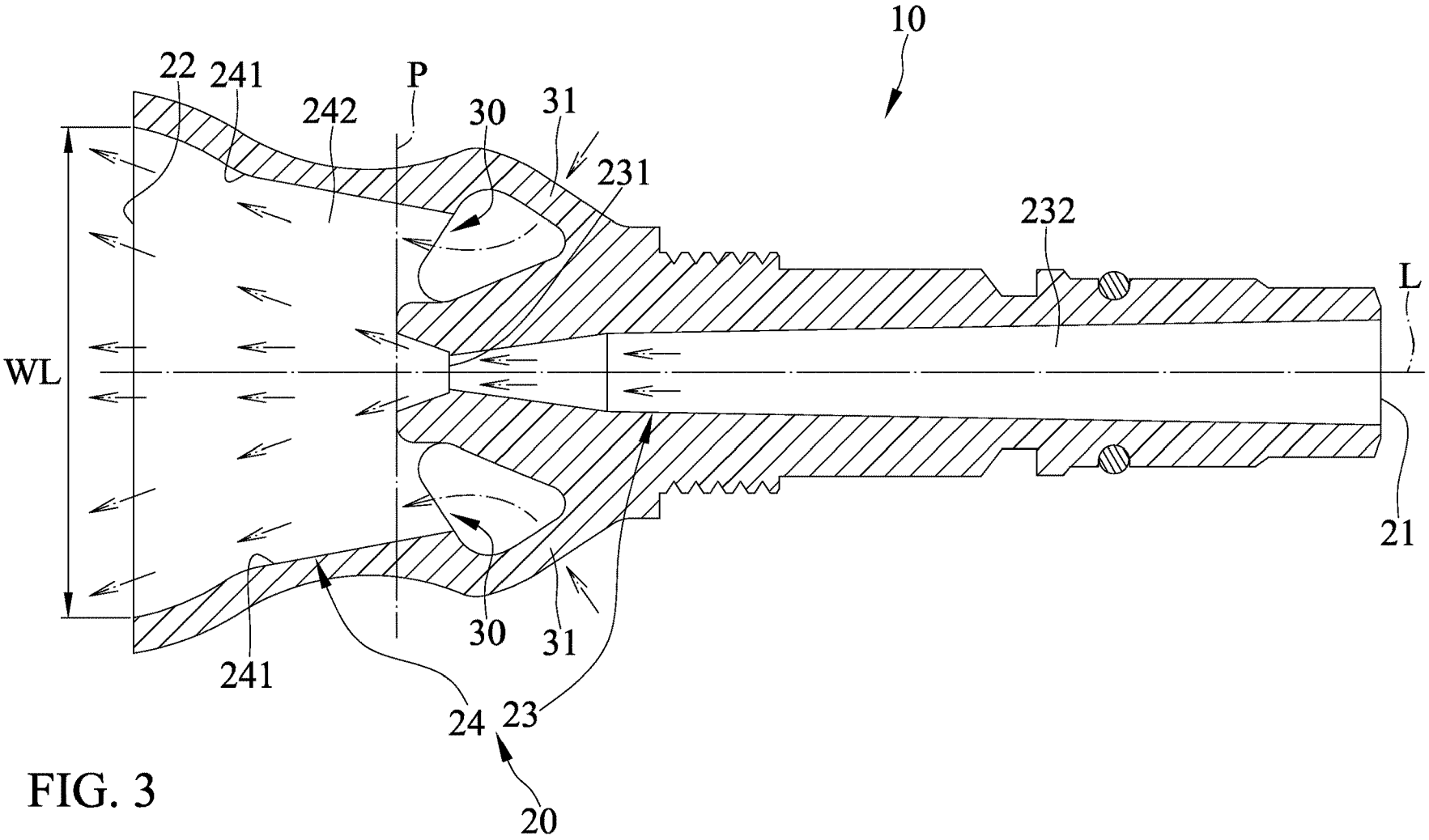
FIG. 3 is cross-sectional view illustrating the head of FIG. 1 including air flowing therethrough, with the air indicated by arrows.
Figure 4:
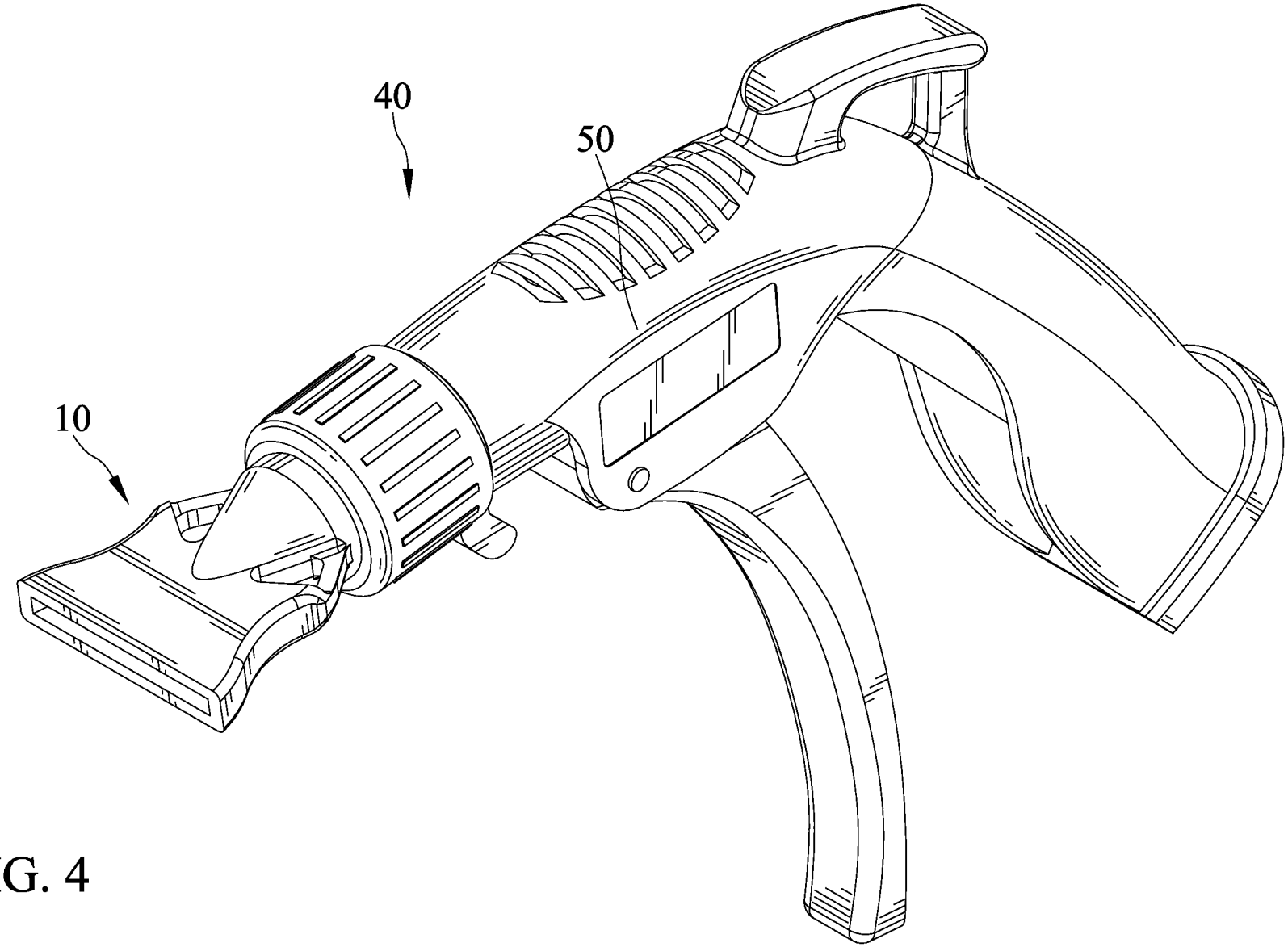
FIG. 4 is a perspective view of a blow gun including the head of FIG. 1.
Figure 5:
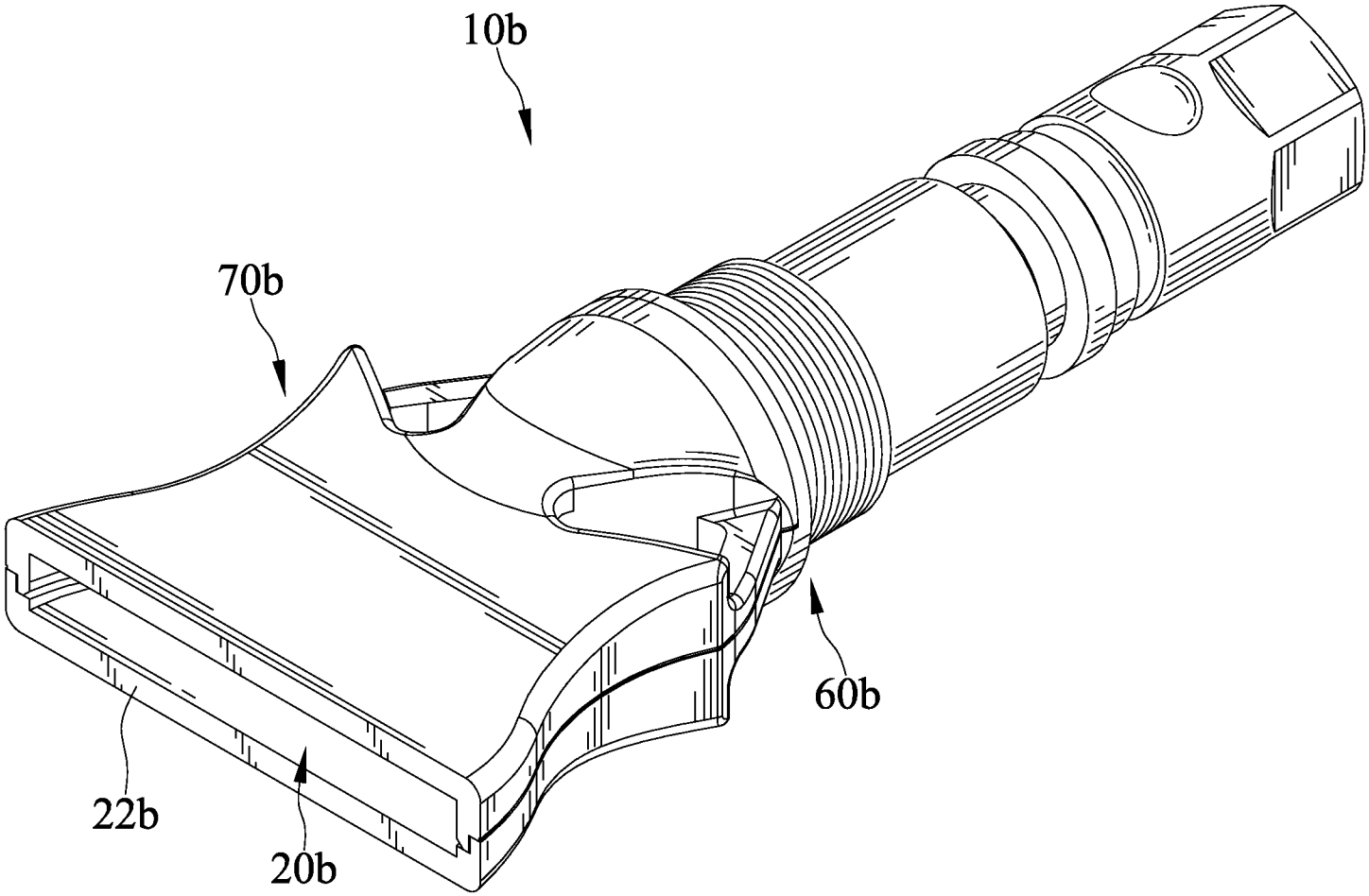
FIG. 5 is a perspective view of a head of a blow gun in accordance with a second embodiment of the invention.
Figure 6:
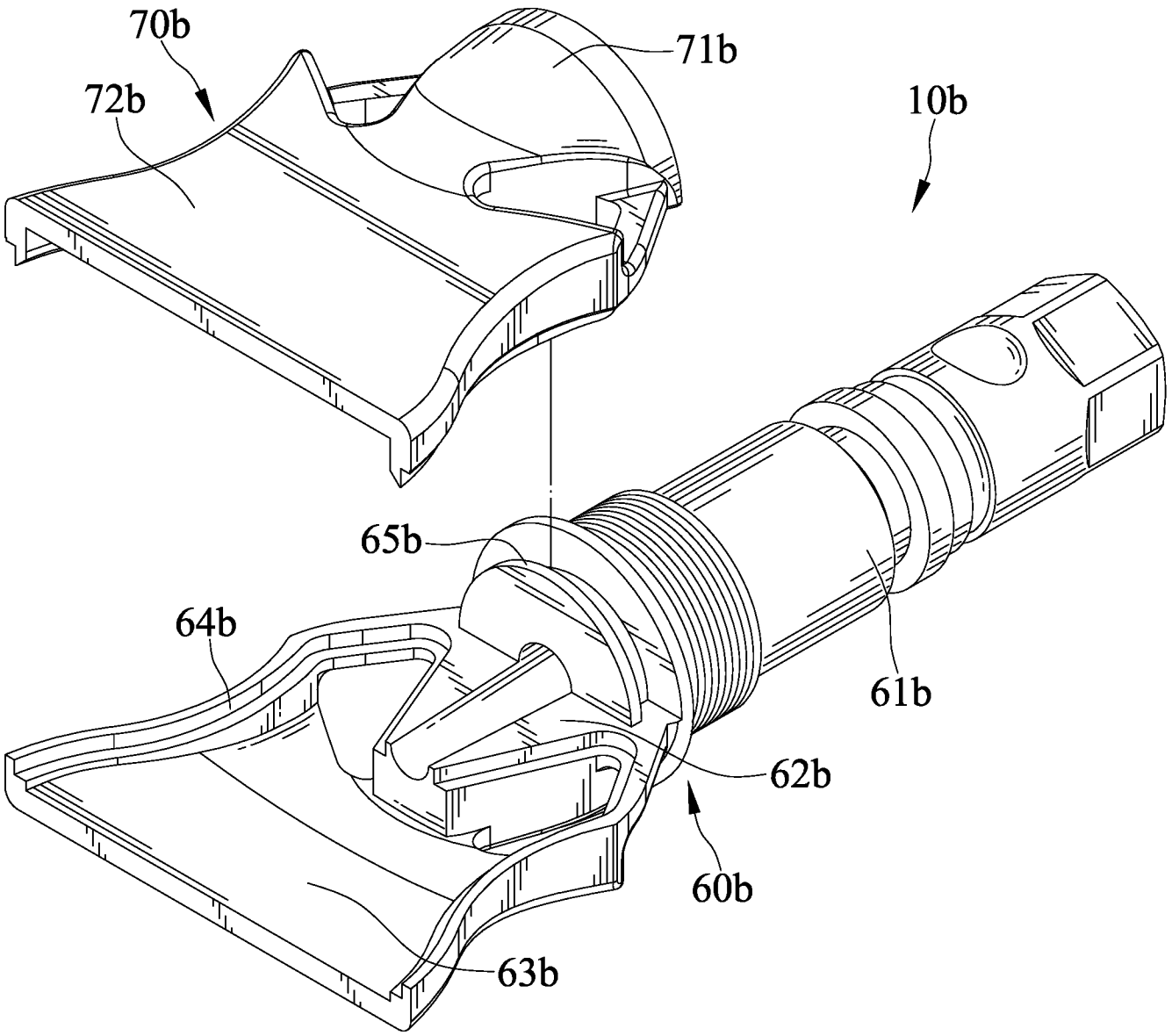
FIG. 6 is an exploded perspective view of the head of FIG. 5.
Figure 7:
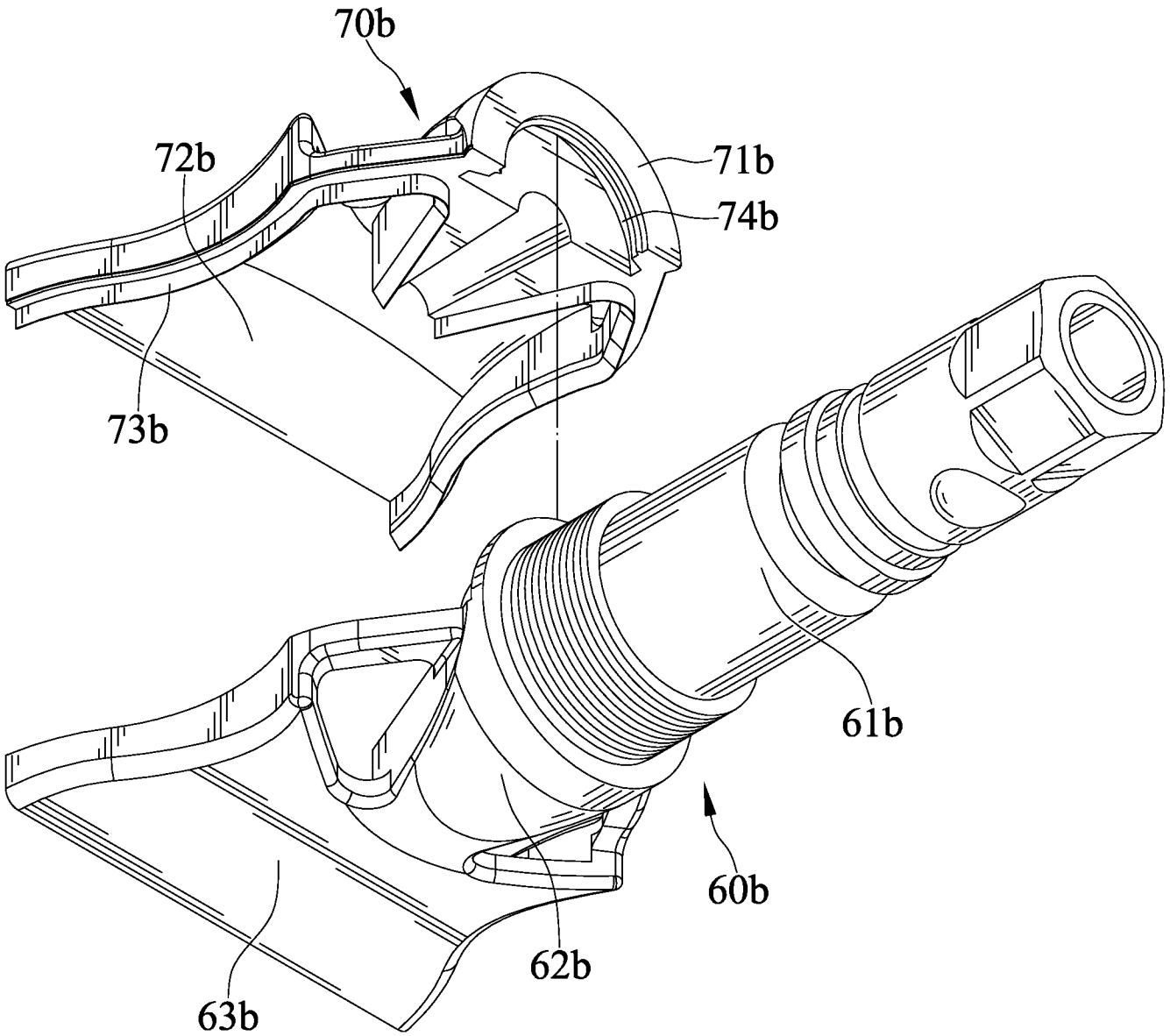
FIG. 7 is an exploded perspective view of the head of FIG. 5 at an angle different from that of FIG. 6.
Figure 8:
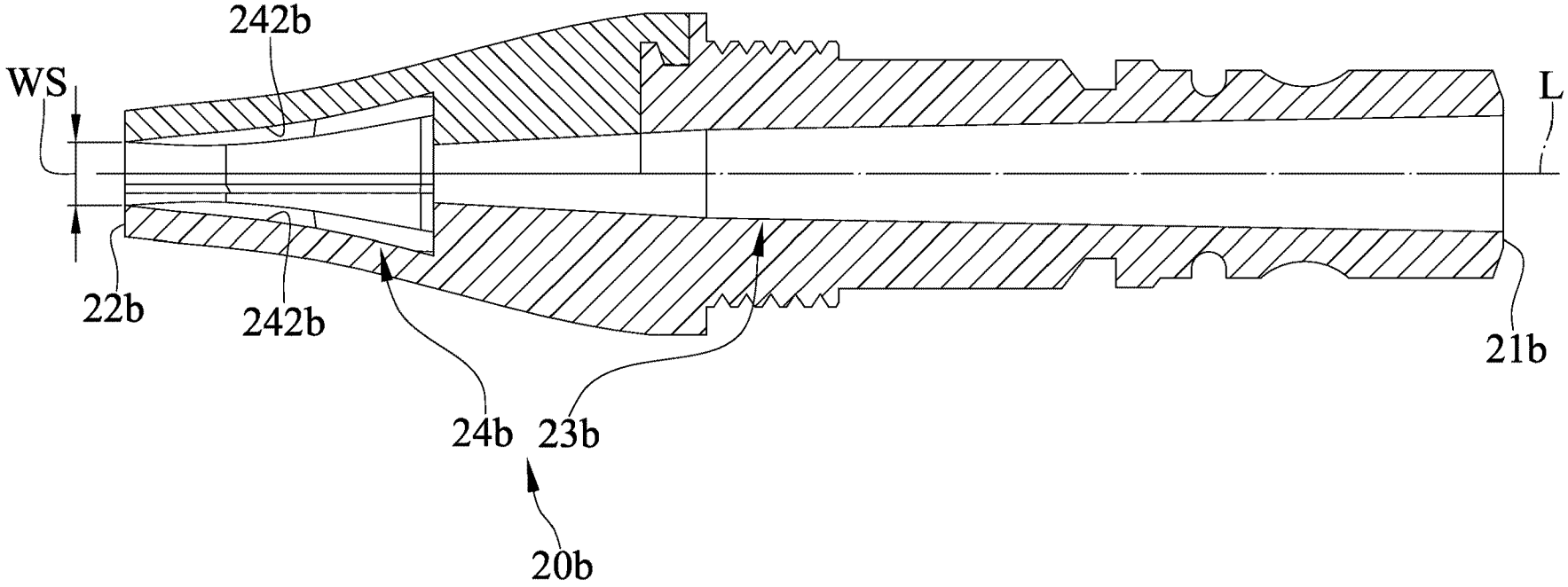
FIG. 8 is a cross-sectional view of the head of FIG. 5.

FIGS. 1 through 3 show a head 10 for a blow gun in accordance with the present invention, and FIG. 4 shows a blow gun 40 including the head 10. The head 10 and a gun body 50 of the blow gun 40 are fluidly connected together.

The head 10 is of a one-piece construction. The head 10 includes an inlet opening 21 and an outlet opening 22 formed by a main channel 20. The main channel 20 extends from the inlet opening 21 to the outlet opening 22.

The main channel 20 defines a first section 23 with a first open end fluidly connected with and adjacent to the inlet opening 21 and a second open end. The first section 23 extends along a longitudinal axis L of the main channel 20. The first section 23 has varying cross sections along the longitudinally axis L. The first section 23 includes a throat section 231 with a cross section being the smallest cross section. The first section 23*b* includes an acceleration section 232 between the first open end thereof and the throat section 231. The acceleration section 232 is a converging section and converges toward the throat section 231 for accelerating air.

The main channel 20 also defines a second section 24 with a first open end fluidly connected with and adjacent to the second open end of the first section 23 and a second open end fluidly connected with and adjacent to the outlet opening 22. The second section 24 extends along the longitudinally axis L of the main channel 20. The second section 24 is of a cross section including two opposite short sides 241 and two opposite long sides 242. The two short sides 241 are two smooth surfaces. The cross section of the second section 24 varies along the longitudinal axis L. The second section 24 is flared in a direction perpendicular to the longitudinal axis L from where a minimum cross section is taken to the outlet opening 22 such that a distance between the short sides 241 is gradually increased from where the minimum cross section is taken to the outlet opening 22. Specifically, a furthest distance between the two short sides 241 is 1.3-1.6 times of a shortest distance between the two short sides 241. The flared second section 24 has the effect of allowing a large amount of air to flow out of the outlet opening 22. A distance between the two long sides 242 is substantially constant from the first open end of the second section 24 to the outlet opening 22.

The outlet opening 22 is delimited by the short sides 241 and the long sides 242 and has a long width WL between the two short sides 241 and a short width WS between the two long sides 242 respectively. The long width WL is at least greater than two times of the short width WS. The minimum cross section of the second section 24 is greater than a maximum cross section of the first section 23. The minimum and maximum cross sections are perpendicular to the axis L.

The second open end of the first section 23 opens on a phantom plane P. The inlet opening 21 is located on a first side of the phantom plane P. The outlet opening 22 is located on a second side of the phantom plane P.

The head 10 also includes at least one side channel 30 located on a side of the main channel 20. The at least one side channel 30 is configured to allow outside air to flow into the second section 24. The at least one side channel 30 has a first open end allowing the outside air to flow therein and a second open end fluidly connected to the second section 24. The at least one side channel 30 is located adjacent to one of the two short sides 241. The at least one side channel 30 is located on the first side of the phantom plane P. Thus, the at least one side channel 30 and the inlet opening 21 are located on the same side of the phantom plane P, and the at least one side channel 30 and the outlet opening 22 are located on opposite sides of the phantom plane P. In the embodiment, the at least one side channel 30 includes two side channels 30, and the main channel 20 is located between the two side channels 30.

The head 10 further includes a rib 31 protruding from an outer wall of the first section 23 to one of the two short sides 241. The rib 31 can reinforce the structure of the head 10.

FIGS. 5 through 9 shows a head 10*b* in accordance with a second embodiment of the present invention, and the same numbers are used to correlate similar components of the first embodiment, but bearing a letter b. The second embodiment is similar to the first embodiment except that the main channel 20*b* and the at least one side channel 30*b* are formed in a combination of a first body 60*b* and a second body 70*b*. Preferably, the first and second bodies 60*b* and 70*b* are coupled together through a high-frequency welding process.

In the embodiment, the first body 60*b* includes a tubular portion 61*b*, a first base portion 62*b*, and a first flow guiding portion 63*b* and the second body 70*b* includes a second base portion 71*b* corresponding to the first base portion 62*b* and a second flow guiding portion 72*b* corresponding to the first flow guiding portion 63*b* respectively. The first section 23*b* extends in the tubular portion 61*b*. The second section 24*b* is bounded by the first and second flow guiding portions 63*b* and 72*b*.

Furthermore, one of the first and second bodies 60*b* and 70*b* has a flange for connection with the other of the first and second bodies 60*b* and 70*b*. In the embodiment, an outer periphery of the first body 60*b* includes a flange 65*b* protruding radially outward and the second body 70*b* includes a recess 74*b* coupling with the flange 65*b*. The flange 65*b* keeps the second body 70*b* in position.

Moreover, the first and second bodies 60*b* and 70*b* includes at least one ridge-and-groove connection. In the embodiment, the first flow guiding portion 63*b* includes two short sides each with a groove 64*b* and the second flow guiding portion 72*b* includes two short sides each forms a ridge 73*b*. The ridges 73*b* on the second flow guiding portion 72*b* correspond to the grooves on the first flow guiding portion 63*b*.

The second embodiment also differentiated from the first embodiment in that a distance between the two long sides 242*b* is gradually reduced from the first open end of the second section 24*b* to the outlet opening 22*b*. Specifically, a furthest distance between the long sides 242*b* is 2-3 times of a shortest distance between the long sides 242*b*.

Figure 9:
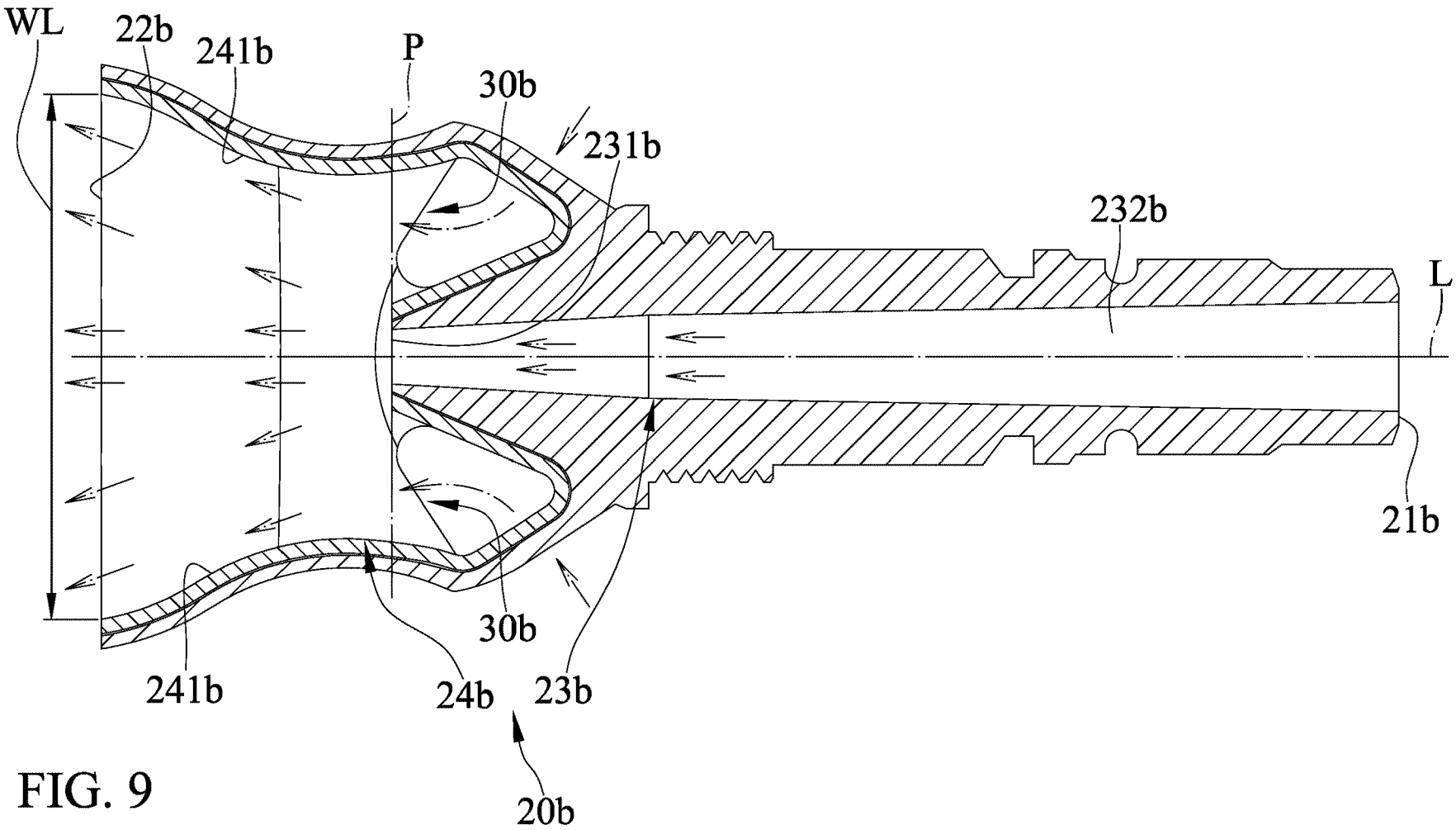
FIG. 9 is another cross-sectional view of the head of FIG. 5.
Figure 10:
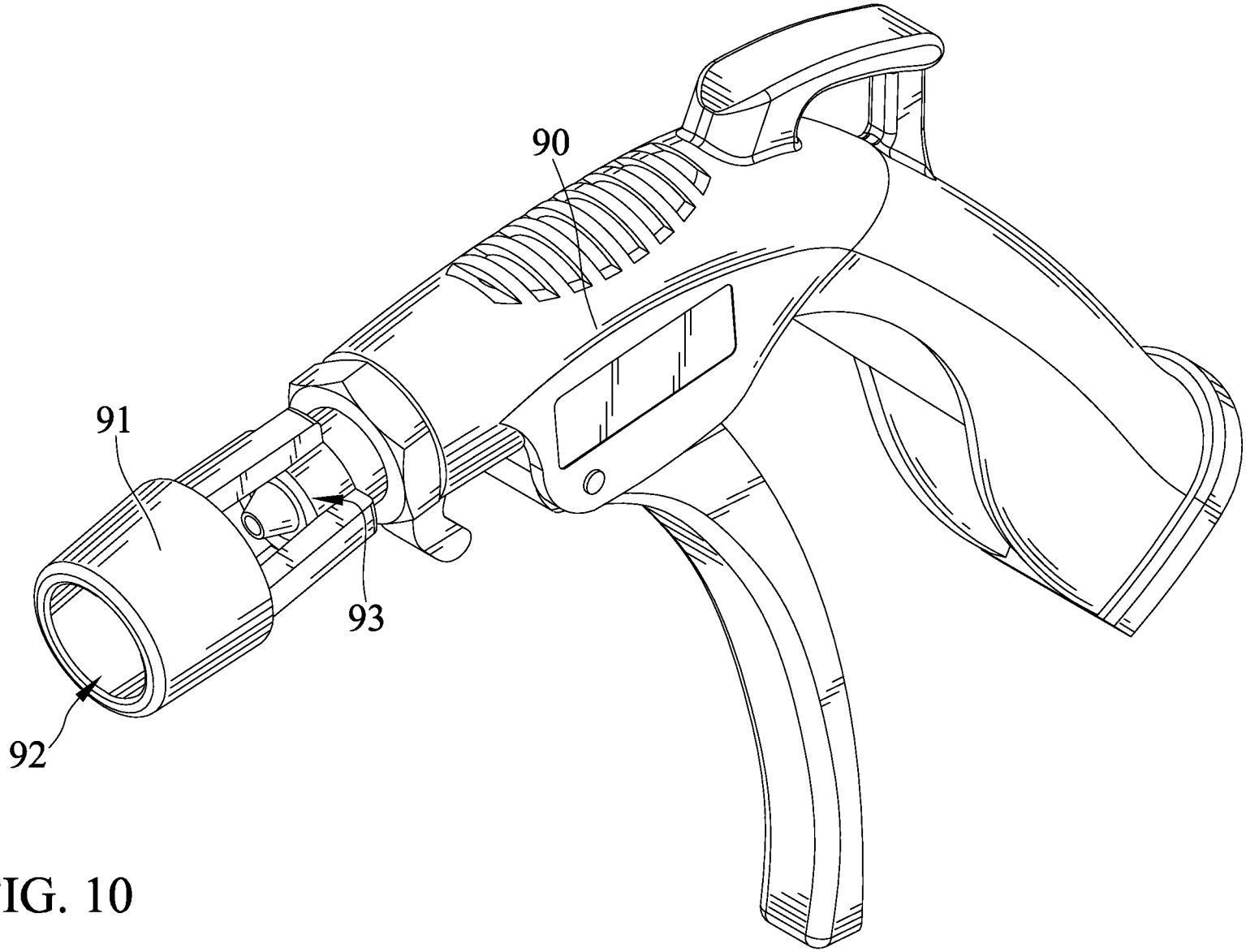
FIG. 10 is a perspective view of a conventional blow gun.
Figure 11:
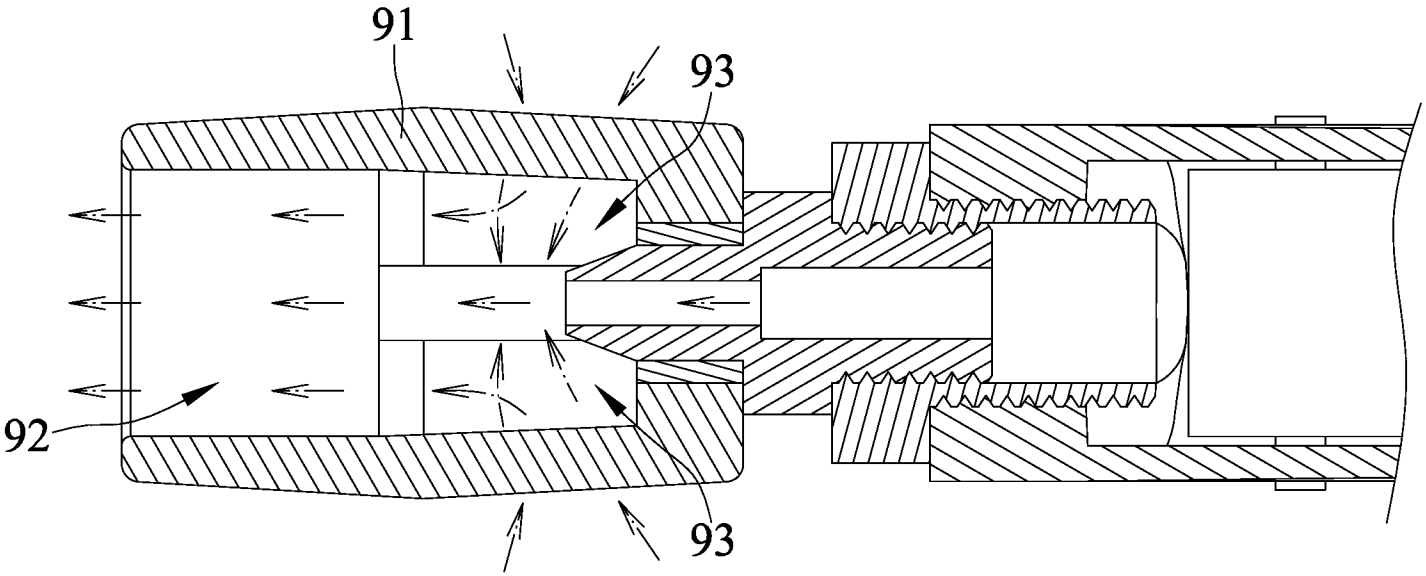
FIG. 11 is a cross-sectional view illustrating the head of FIG. 10 including air flowing therethrough, with the air indicated by arrows.

In view of the foregoing, the heads 10 and 10*b* are suitable for the blow gun 40 that blows a large amount of air. Further, as shown in FIGS. 3 and 9, no turbulent flows are created, because the two short sides 241 and 241*b* are two smooth surfaces and outside air can flow into the second sections 24 and 24*b* through the side channels 30 and 30*b*.

The foregoing is merely illustrative of the principles of this invention, and various modifications can be made by those skilled in the art without departing from the scope and spirit of the invention.

What is claimed is:

1. A head of a blow gun comprising:

an inlet opening and an outlet opening formed by a main channel, wherein the main channel extends from the inlet opening to the outlet opening, wherein the main channel defines a first section with a first open end fluidly connected with and adjacent to the inlet opening and a second open end and extends along a longitudinal axis of the main channel, wherein the main channel defines a second section with a first open end fluidly connected with and adjacent to the second open end of the first section and a second open end fluidly connected with and adjacent to the outlet opening and extends along the longitudinal axis of the main channel, wherein the second section is of a cross section including two opposite short sides and two opposite long sides, wherein the cross section of the second section varies along the longitudinal axis, wherein the outlet opening is delimited by the short sides and the long sides and has a long width between the two short sides and a short width between the two long sides respectively, wherein the long width is at least greater than two times of the short width, wherein the second section has a minimum cross section defined at its first open end; and at least one side channel configured to allow outside air to flow into the second section, wherein the at least one side channel has a first open end allowing the outside air to flow therein and a second open end fluidly connected to the second section, and wherein the first open end of the at least one side channel is located at a part of the head which forms an outer wall of the second section and is exposed, wherein the second section is flared in a direction perpendicular to the longitudinal axis from where the minimum cross section is taken to the outlet opening such that a distance between the short sides is gradually increased from where the minimum cross section is taken to the outlet opening, wherein a furthest distance between the two short sides is 1.3-1.6 times of a shortest distance between the two short sides, and wherein a distance between the two long sides is gradually reduced from the first open end of the second section to the outlet opening, and wherein a furthest distance between the long sides is 2-3 times of a shortest distance between the long sides.

2. The head as claimed in claim 1, wherein the second open end of the first section opens on a phantom plane, which is perpendicular to the longitudinal axis, and wherein the first open end of the at least one side channel and the inlet opening are located on a same side of the phantom plane.

3. The head as claimed in claim 1, wherein the at least one side channel is located adjacent to one of the two short sides.

4. The head as claimed in claim 1, wherein the at least one side channel includes two side channels, and wherein the main channel is located between the two side channels.

5. The head as claimed in claim 1, wherein the first section has varying cross sections along the longitudinal axis, and wherein the first section includes a throat section with a cross section being the smallest cross section.

6. The head as claimed in claim 5, wherein the first section includes an acceleration section between the first open end thereof and the throat section, and wherein the acceleration section is a converging section and converges toward the throat section for accelerating air.

7. A head of a blow gun comprising:

an inlet opening and an outlet opening formed by a main channel, wherein the main channel extends from the inlet opening to the outlet opening, wherein the main channel defines a first section with a first open end fluidly connected with and adjacent to the inlet opening and a second open end and extends along a longitudinal axis of the main channel, wherein the main channel defines a second section with a first open end fluidly connected with and adjacent to the second open end of the first section and a second open end fluidly connected with and adjacent to the outlet opening and extends along the longitudinal axis of the main channel, wherein the second section is of a cross section including two opposite short sides and two opposite long sides, wherein the cross section of the second section varies along the longitudinal axis, wherein the outlet opening is delimited by the short sides and the long sides and has a long width between the two short sides and a short width between the two long sides respectively, wherein the long width is at least greater than two times of the short width, wherein the second section has a minimum cross section defined at its first open end; and at least one side channel configured to allow outside air to flow into the second section, wherein the at least one side channel has a first open end allowing the outside air to flow therein and a second open end fluidly connected to the second section, and wherein the first open end of the at least one side channel is located at a part of the head which forms an outer wall of the second section and is exposed, wherein the main channel and the at least one side channel are formed in a combination of a first body and a second body, with the first body defining half of the main channel and the at least one side channel, and with the second body defining another half of the main channel and the at least one side channel.

8. The head as claimed in claim 7, wherein the first and second bodies are coupled together through a high-frequency welding process.

9. The head as claimed in claim 7, wherein the first body includes a tubular portion, a first base portion, and a first flow guiding portion and the second body includes a second base portion corresponding to the first base portion and a second flow guiding portion corresponding to the first flow guiding portion respectively, wherein the first section extends in the tubular portion, and wherein the second section is bounded by the first and second flow guiding portions.

10. The head as claimed in claim 9, wherein one of the first and second bodies has a flange for connection with the other of the first and second bodies.

11. The head as claimed in claim 7, wherein a distance between the short sides is gradually increased from where the minimum cross section is taken to the outlet opening such that the second section is flared in a direction perpendicular to the longitudinal axis.

12. The head as claimed in claim 11, wherein the second open end of the first section opens on a phantom plane, which is perpendicular to the longitudinal axis, and wherein the first open end of the at least one side channel and the inlet opening are located on a same side of the phantom plane.

13. The head as claimed in claim 7, wherein the first section has varying cross sections along the longitudinal axis, wherein the first section includes a throat section with a cross section being the smallest cross section, wherein the first section includes an acceleration section between the first open end thereof and the throat section, and wherein the acceleration section is a converging section and converges toward the throat section for accelerating air.

* * * * *